US008487968B2

(12) United States Patent
Kim et al.

(10) Patent No.: US 8,487,968 B2
(45) Date of Patent: Jul. 16, 2013

(54) DISPLAY DEVICE AND CONTRAST ENHANCEMENT METHOD THEREOF

(75) Inventors: Suhyung Kim, Paju-si (KR); Seonggyun Kim, Gunpo-si (KR)

(73) Assignee: LG Display Co., Ltd., Seoul (KR)

( * ) Notice: Subject to any disclaimer, the term of this patent is extended or adjusted under 35 U.S.C. 154(b) by 221 days.

(21) Appl. No.: 12/944,323

(22) Filed: Nov. 11, 2010

(65) Prior Publication Data

US 2011/0317074 A1 Dec. 29, 2011

(30) Foreign Application Priority Data

Jun. 25, 2010 (KR) ..... 10-2010-0060510

(51) Int. Cl.
*G09G 5/10* (2006.01)

(52) U.S. Cl.
USPC ..... 345/690; 345/89; 345/100; 345/204

(58) Field of Classification Search
USPC ..... 345/89, 204, 690, 100
See application file for complete search history.

(56) References Cited

U.S. PATENT DOCUMENTS 5,235,434 A * 8/1993 Wober ..... 358/448
5,724,456 A * 3/1998 Boyack et al. ..... 382/274
5,808,697 A * 9/1998 Fujimura et al. ..... 348/672
7,113,648 B1 * 9/2006 Aihara ..... 382/274
7,142,712 B2 * 11/2006 Maruoka et al. ..... 382/168
7,289,154 B2 * 10/2007 Gindele ..... 348/364
7,369,183 B2 * 5/2008 Oka et al. ..... 348/674
7,443,377 B2 * 10/2008 Kim ..... 345/102
7,483,083 B2 * 1/2009 Li et al. ..... 348/673
7,688,294 B2 * 3/2010 Baik ..... 345/88
7,978,159 B2 * 7/2011 Kim et al. ..... 345/77
8,077,219 B2 * 12/2011 Delva et al. ..... 348/230.1
8,125,569 B2 * 2/2012 Flores et al. ..... 348/672
2003/0145919 A1 * 8/2003 Freier et al. ..... 148/602
2005/0122287 A1 * 6/2005 Nishitani et al. ..... 345/63
2005/0179625 A1 * 8/2005 Choi et al. ..... 345/76
2005/0212725 A1 * 9/2005 Sasaki et al. ..... 345/63
2006/0061842 A1 * 3/2006 Oka et al. ..... 358/522
2007/0165947 A1 * 7/2007 Paik ..... 382/169
2007/0268524 A1 * 11/2007 Nose et al. ..... 358/3.01
2007/0285366 A1 * 12/2007 Ha et al. ..... 345/87
2007/0291048 A1 * 12/2007 Kerofsky ..... 345/589
2008/0037866 A1 * 2/2008 Na ..... 382/168
2008/0297467 A1 * 12/2008 Hsu et al. ..... 345/102

* cited by examiner

*Primary Examiner* — Lun-Yi Lao
*Assistant Examiner* — Peter D McLoone
(74) *Attorney, Agent, or Firm* — Brinks Hofer Gilson & Lione

(57) ABSTRACT

A display device and a contrast enhancement method thereof are disclosed. The display device includes a display panel on which data lines and gate lines are positioned, a data driving circuit for driving the data lines, a scan driving circuit for driving the gate lines, a timing controller for controlling the data driving circuit and the scan driving circuit, and a data modulation circuit including a local modulation circuit and a global modulation circuit. The local modulation circuit maps luminance components of input digital video data to a luminance transfer curve selected or generated for each pixel based on an average picture level (APL) of each pixel and performs a first modulation on the luminance components of the input digital video data so as to expand a gray level distribution of a specific portion of an input image.

10 Claims, 9 Drawing Sheets

10

| | | | | | |
|---|---|---|---|---|---|
| B(0, 0) | B(0, 1) | B(0, 2) | B(0, 3) | · · · · | B(0, m-1) |
| B(1, 0) | | | | | |
| B(2, 0) | | | | | |
| ⋮ | | ⋮ | | · · · · | |
| B(n-1, 0) | | | | | B(n-1, m-1) |

(A) Original image (B) Local+Global Dynamic Contrast result image (C) Only Global Dynamic Contrast result image

DISPLAY DEVICE AND CONTRAST ENHANCEMENT METHOD THEREOF

This application claims the benefit of Korea Patent Application No. 10-2010-0060510 filed on Jun. 25, 2010, the entire contents of which is incorporated herein by reference for all purposes as if fully set forth herein.

BACKGROUND

1. Field of the Invention

Exemplary embodiments of the disclosure relate to a display device and a contrast enhancement method thereof.

2. Discussion of the Related Art

Examples of a display device include a liquid crystal display (LCD), a field emission display (FED), a plasma display panel (PDP), and an organic light emitting diode (OLED) display. Most of them have been put to practical use in electric home appliances or personal digital appliances, etc. and have been marketed.

The image quality of the display device depends on contrast characteristic. U.S. Pat. No. 7,102,697 discloses an example of a method capable of improving the contrast characteristic. More specifically, U.S. Pat. No. 7,102,697 discloses a typical global contrast enhancement method. In U.S. Pat. No. 7,102,697, a luminance transfer curve is generated through a histogram analysis of a previous frame, and digital video data of a current frame is mapped to the luminance transfer curve, thereby performing a contrast enhancement of an image.

However, in U.S. Pat. No. 7,102,697, because the histogram analysis of the previous frame does not include detailed informations of the image, when a contrast ratio of the image uniformly increases, a detailed portion of the image is inevitably damaged. For example, when the contrast ratio of the image increases, a very dark portion in one frame becomes darker than an original image and a very bright portion in one frame becomes brighter than the original image. Therefore, the detailed portion of the image is inevitably damaged.

BRIEF SUMMARY

Exemplary embodiments of the disclosure provide a display device and a contrast enhancement method thereof capable of minimizing a detailed loss of an image and improving contrast characteristics.

In one aspect, there is a display device comprising a display panel on which data lines and gate lines are positioned, a data driving circuit configured to drive the data lines, a scan driving circuit configured to drive the gate lines, a timing controller configured to control the data driving circuit and the scan driving circuit, and a data modulation circuit including a local modulation circuit and a global modulation circuit, the local modulation circuit being configured to map luminance components of input digital video data to a luminance transfer curve selected or generated for each pixel based on an average picture level (APL) of each pixel and perform a first modulation on the luminance components of the input digital video data so as to expand a gray level distribution of a specific portion of an input image, the global modulation circuit being configured to perform a second modulation on first modulated luminance components of the input digital video data so as to improve an entire contrast characteristic of the input image and supply second modulated luminance components of the input digital video data to the timing controller.

In another aspect, there is a contrast enhancement method of a display device including a display panel on which data lines and gate lines are positioned, a data driving circuit for driving the data lines, a scan driving circuit for driving the gate lines, a timing controller for controlling the data driving circuit and the scan driving circuit, the contrast enhancement method comprising mapping luminance components of input digital video data to a luminance transfer curve selected or generated for each pixel based on an average picture level (APL) of each pixel and performing a first modulation on the luminance components of the input digital video data so as to expand a gray level distribution of a specific portion of an input image, and performing a second modulation on first modulated luminance components of the input digital video data so as to improve an entire contrast characteristic of the input image and supplying second modulated luminance components of the input digital video data to the timing controller.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE DRAWINGS AND THE PRESENTLY PREFERRED EMBODIMENTS

Reference will now be made in detail embodiments of the invention examples of which are illustrated in the accompanying drawings.

Figure 1:
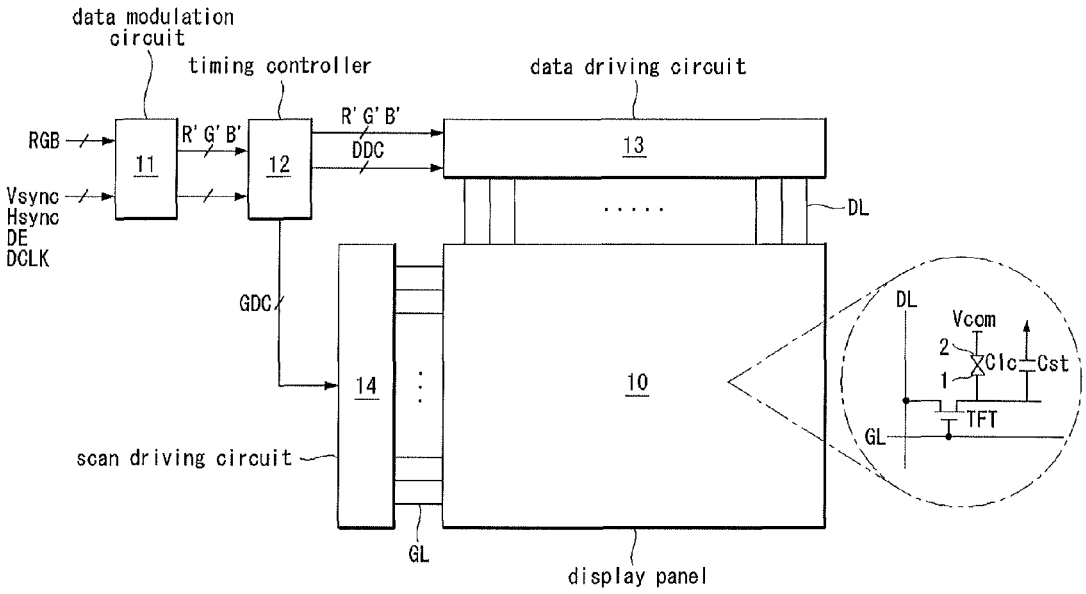
FIG. 1 illustrates a display device according to an exemplary embodiment of the invention.

FIG. 1 illustrates a display device according to an exemplary embodiment of the invention.

As shown in FIG. 1, the display device may be implemented as a flat panel display device such as a liquid crystal display (LCD), a field emission display (FED), a plasma display panel (PDP), and an organic light emitting diode (OLED) display. In the following description, the liquid crystal display is taken as an example of the display device.

The display device includes a display panel 10, a data modulation circuit 11, a timing controller 12, a data driving circuit 13, and a scan driving circuit 14.

The display panel 10 includes an upper glass substrate, a lower glass substrate, and a liquid crystal layer formed between the upper and lower glass substrates. A plurality of data lines DL and a plurality of gate lines GL are positioned to cross one another on the lower glass substrate of the display panel 10. A plurality of liquid crystal cells Clc are arranged on the display panel 10 in a matrix form based on a crossing structure of the data lines DL and the gate lines GL. Each of the liquid crystal cells Clc includes a thin film transistor (TFT), a pixel electrode 1 connected to the TFT, a common electrode 2 opposite the pixel electrode 1, a storage capacitor Cst, and the like. Black matrixes, color filters, etc. are formed on the upper glass substrate of the display panel 10. In a vertical electric field driving manner such as a twisted nematic (TN) mode and a vertical alignment (VA) mode, the common electrode 2 is formed on the upper glass substrate. In a horizontal electric field driving manner such as an in-plane switching (IPS) mode and a fringe field switching (FFS) mode, the common electrode 2 is formed on the lower glass substrate along with the pixel electrode 1. The liquid crystal cells Clc include R liquid crystal cells for red display, G liquid crystal cells for green display, and B liquid crystal cells for blue display. The R liquid crystal cell, the G liquid crystal cell, and the B liquid crystal cell constitute a unit pixel. Polarizing plates are respectively attached to the upper and lower glass substrates of the display panel 10. Alignment layers for setting a pre-tilt angle of liquid crystals are respectively formed on the inner surfaces contacting the liquid crystals in the upper and lower glass substrates of the display panel 10.

The data modulation circuit 11 performs both a global contrast enhancement and a local contrast enhancement, thereby minimizing a detailed loss of an image and improving contrast characteristic. The data modulation circuit 11 performs the local contrast enhancement prior to the global contrast enhancement. The data modulation circuit 11 previously expands a gray level distribution of a detailed portion of the image (for example, a very dark portion or a very bright portion of the image) through the local contrast enhancement, thereby minimizing the detailed loss of the image to be generated in the global contrast enhancement. The data modulation circuit 11 sequentially modulates luminance components of digital video data RGB received from a system board (not shown) in conformity with the improvement of the local and global contrast characteristics and then supplies the modulated digital video data R'G'B' to the timing controller 12. Further, the data modulation circuit 11 supplies timing signals Vsync, Hsync, DE, and DCLK received from the system board to the timing controller 12. The data modulation circuit 11 is described in detail below with reference to FIGS. 2 to 9.

The timing controller 12 arranges the modulated digital video data R'G'B' received from the data modulation circuit 11 in conformity with a resolution of the display panel 10 and supplies the modulated digital video data R'G'B' to the data driving circuit 13.

The timing controller 12 generates a data control signal DDC for controlling operation timing of the data driving circuit 13 and a scan control signal GDC for controlling operation timing of the scan driving circuit 14 based on the timing signals Vsync, Hsync, DE, and DCLK received from the data modulation circuit 11. The data control signal DDC includes a source start pulse SSP, a source sampling clock SSC, a polarity control signal POL, a source output enable SOE, and the like. The scan control signal GDC includes a gate start pulse GSP, a gate shift clock GSC, a gate output enable GOE, and the like.

The data driving circuit 13 includes a plurality of source driver integrated circuits (ICs). The data driving circuit 13 latches the modulated digital video data R'G'B' received from the timing controller 12 in response to the data control signal DDC and converts the modulated digital video data R'G'B' into positive and negative analog gamma compensation voltages. The data driving circuit 13 then supplies the positive and negative analog gamma compensation voltages to the data lines DL.

The scan driving circuit 14 generates a scan pulse (or a gate pulse) in response to the scan control signal GDC and then sequentially supplies the scan pulse to the gate lines GL.

The display device may be implemented as a reflective display device or a backlit display device. The backlit display device may further include a backlight unit for providing light to the display panel 10. The backlight unit may be implemented as an edge type backlight unit, in which light sources are positioned opposite the side of a light guide plate, or a direct type backlight unit, in which light sources are positioned under a diffusion plate.

Figure 2:
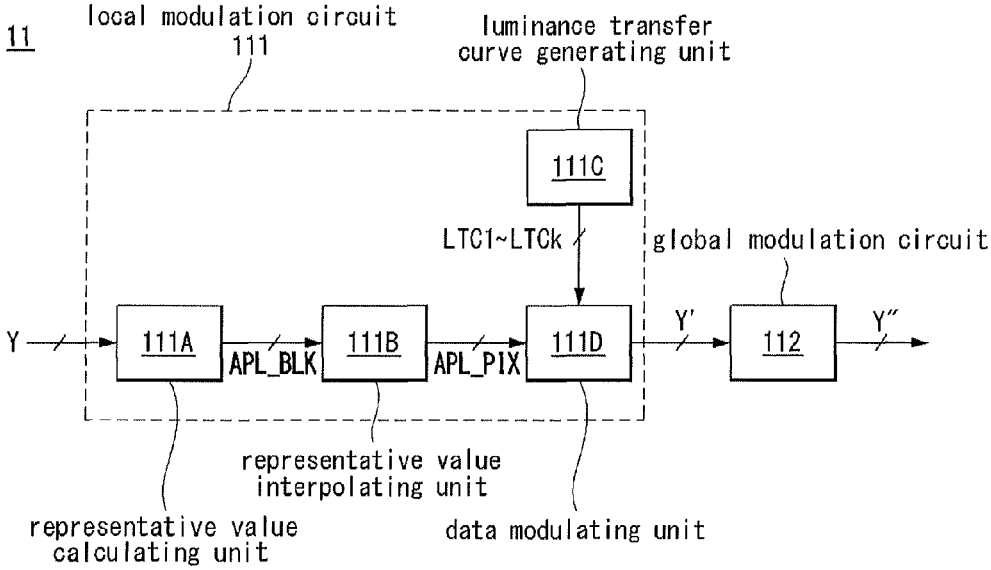
FIG. 2 illustrates an exemplary configuration of a data modulation circuit.

FIG. 2 illustrates an exemplary configuration of the data modulation circuit 11.

As shown in FIG. 2, the data modulation circuit 11 includes a local modulation circuit 111 for local contrast enhancement and a global modulation circuit 112 for global contrast enhancement.

The local modulation circuit 111 includes a representative value calculating unit 111A, a representative value interpolating unit 111B, a luminance transfer curve generating unit 111C, and a data modulating unit 111D.

Figures 3, 4A:
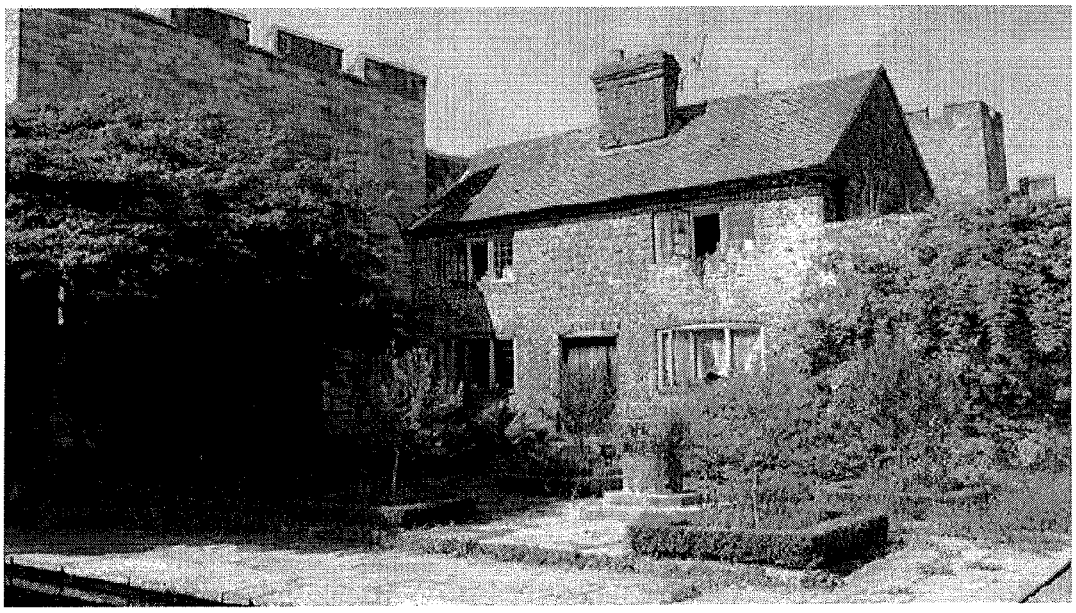
FIG. 3 illustrates a plurality of virtual blocks obtained by dividing a display screen of a display device in a matrix form.
FIG. 4A illustrates an input image.
Figure 4B:
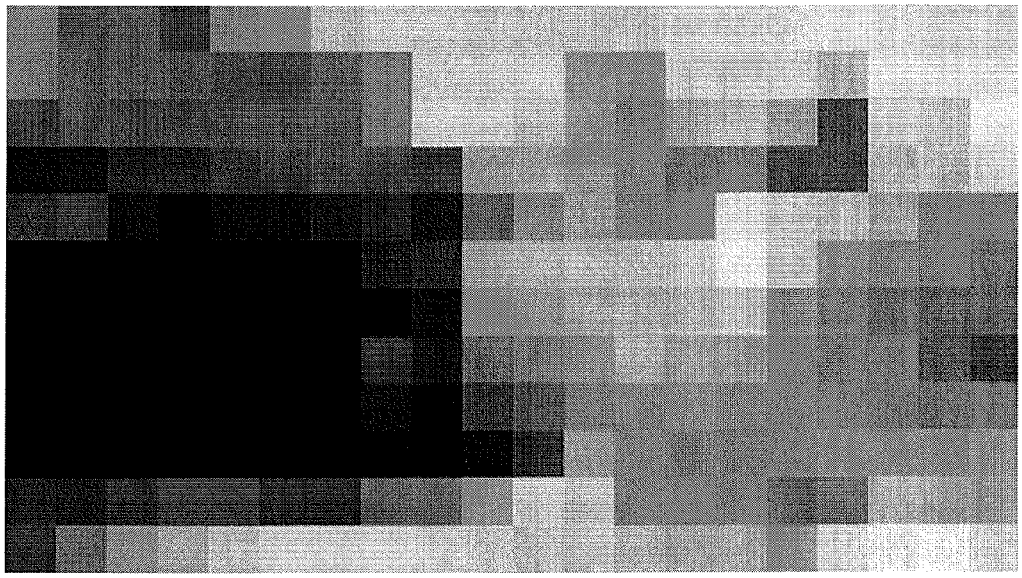
FIG. 4B illustrates an image based on a calculated average picture level (APL) of each block.

The representative value calculating unit 111A receives luminance components Y of the input digital video data RGB (for example, luminance components shown in FIG. 4A) from a luminance/color difference component separating unit (not shown) included in the data modulation circuit 11. The representative value calculating unit 111A matches the luminance components Y of the input digital video data RGB to a plurality of virtual blocks B (0, 0) to B (n−1, m−1) obtained by dividing a display screen of the display panel 10 in a matrix form as shown in FIG. 3 to calculate a representative value of each of the virtual blocks B (0, 0) to B (n−1, m−1). The representative value of each block may be implemented by an average picture level (APL) of each block. The representative value calculating unit 111A obtains a maximum gray level of each pixel in each block and divides a sum of the maximum gray levels of the pixels included in each block by the total number of pixels of each block, so as to calculate an APL APL_BLK of each block as shown in FIG. 4B.

Figure 4C:
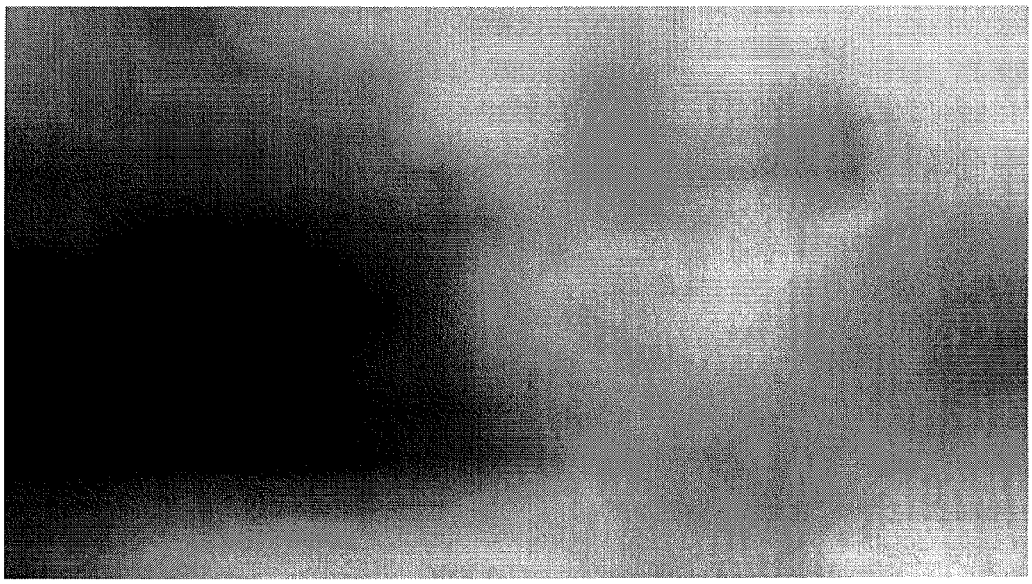
FIG. 4C illustrates an image based on an interpolated APL of each block.

As shown in FIG. 4C, the representative value interpolating unit 111B interpolates the APL APL_BLK of each block and converts the APL APL_BLK of each block into an APL APL_PIX of each pixel.

Figure 4D:
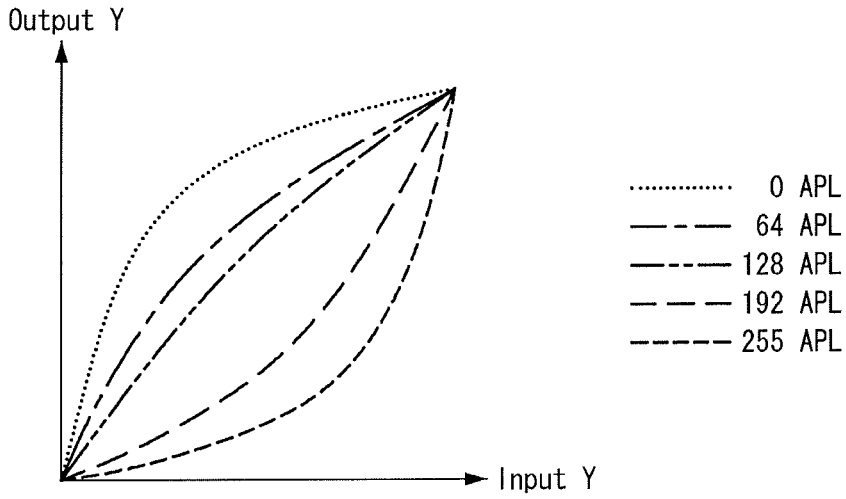
FIG. 4D illustrates exemplary luminance transfer curves based on an APL of each block.

The luminance transfer curve generating unit 111C generates a plurality of luminance transfer curves LTC1 to LTCk previously determined based on the APLs. For example, as shown in FIG. 4D, the luminance transfer curve generating unit 111C may generate five previously determined luminance transfer curves respectively corresponding to 0 APL, 64 APL, 128 APL, 192 APL, and 255 APL. The luminance transfer curves LTC1 to LTCk are set to have different slopes in a plane of input luminance Y-output luminance Y based on the corresponding APLs. In particular, the luminance transfer curves LTC1 to LTCk are set to have slopes capable of expanding a gray level distribution in a specific portion (for example, a portion with a gray level equal to or less than about 40% of a peak white gray level or a portion with a gray level equal to or greater than about 60% of the peak white gray level) of the input image.

Figure 4E:
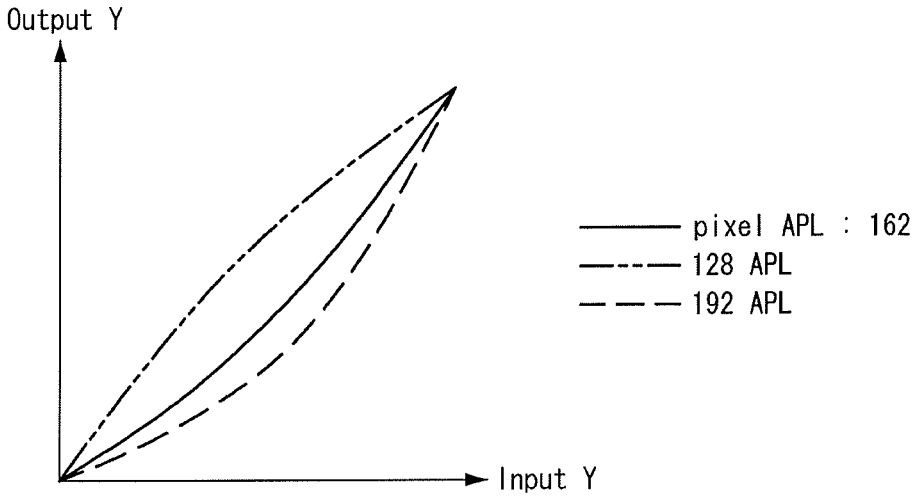
FIG. 4E illustrates an exemplary luminance transfer curve corresponding to an APL of each pixel.
Figure 4F:
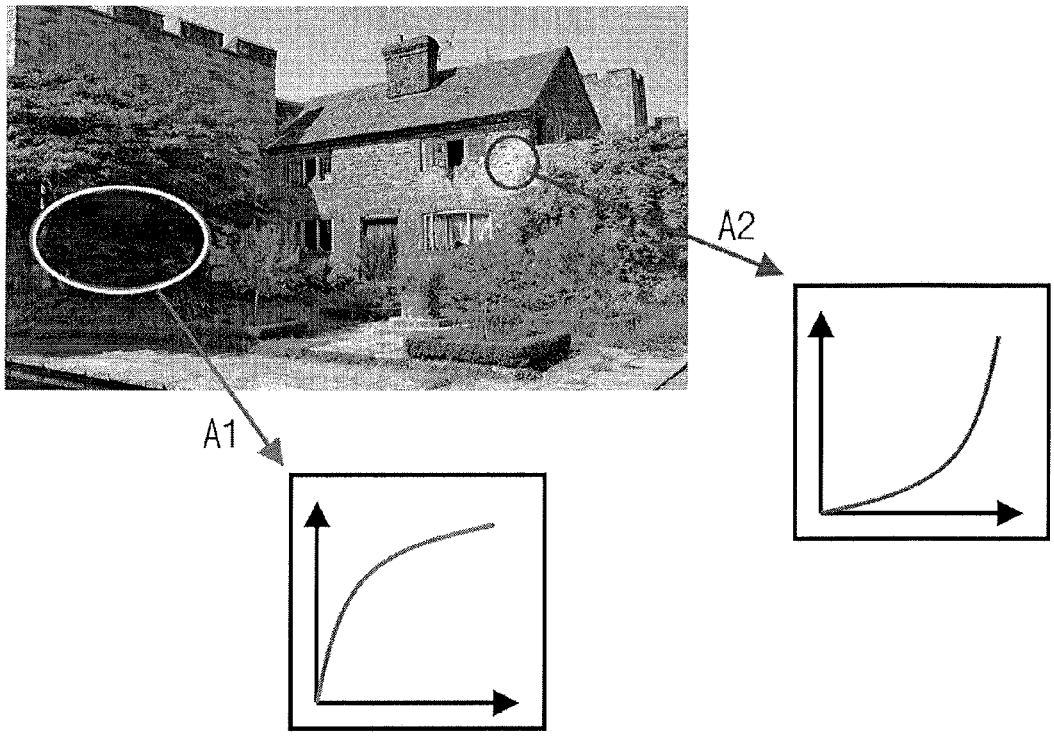
FIG. 4F illustrates an image on which a local contrast enhancement is performed.

The data modulating unit 111D receives the APL APL_PIX of each pixel from the representative value interpolating unit 111B and receives the luminance transfer curves LTC1 to LTCk from the luminance transfer curve generating unit 111C. The data modulating unit 111D selects a luminance transfer curve most suitable for each pixel based on the APL APL_PIX of each pixel. It is preferable that the number of luminance transfer curves is less than the number of APLs for a size reduction of hardware. Alternatively, as shown in FIG. 4E, the data modulating unit 111D may interpolates adjacent luminance transfer curves at opposite sides of the APL APL_PIX of each pixel to generate a luminance transfer curve corresponding to the APL APL_PIX of each pixel. The data modulating unit 111D maps the luminance components Y of the input digital video data RGB to the luminance transfer curve selected or generated for each pixel and performs a first modulation on the luminance components Y of the input digital video data RGB. The data modulating unit 111D then outputs first modulated luminance components Y'. FIG. 4F illustrates an image whose the local contrast enhancement is performed through the first modulation. As shown in FIG. 4F, a gray level distribution of each of a dark portion A1 and a bright portion A2 is expanded, and thus a loss of the detailed portion (i.e., the dark portion A1 and the bright portion A2) of the image are greatly reduced and prevented.

The global modulation circuit 112 receives the first modulated luminance components Y' from the local modulation circuit 111. The global modulation circuit 112 performs a second modulation on the first modulated luminance components Y' using various known methods and then outputs second modulated luminance components Y". The entire contrast i.e., the global contrast of the image is improved through the second modulation. The second modulated luminance components Y" are combined with color difference components U and V by a luminance/color difference component combining unit (not shown) included in the data modulation circuit 11 to generate the modulated digital video data R'G'B'.

Figure 5:
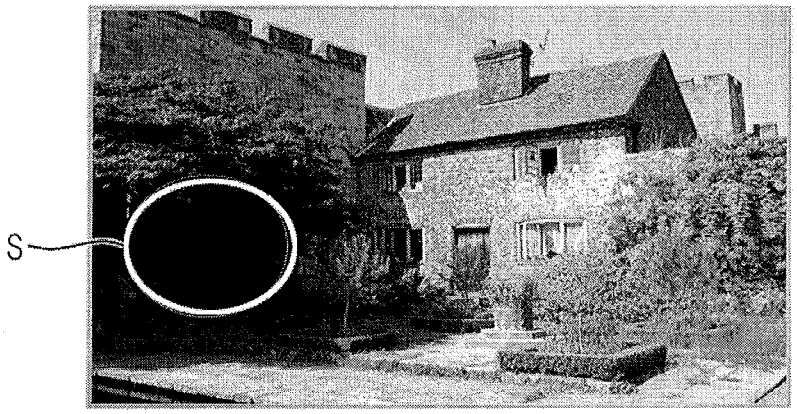
FIG. 5 illustrates a detailed enhancement effect when both a local contrast and a global contrast are enhanced, compared with a detailed enhancement effect when only a global contrast is enhanced in the related art.
Figure 5:
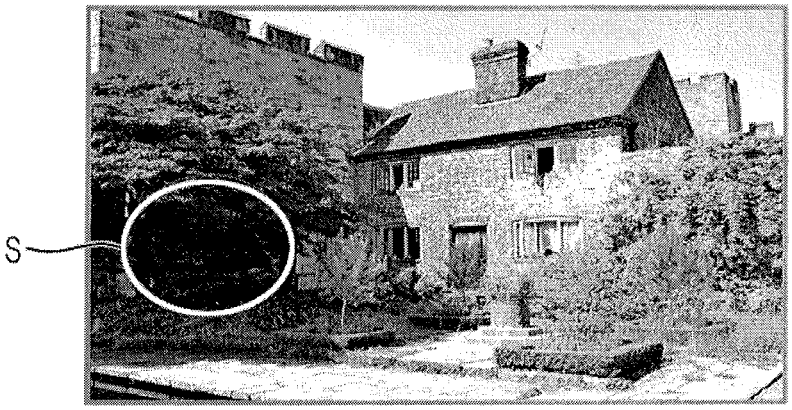
Figure 5:
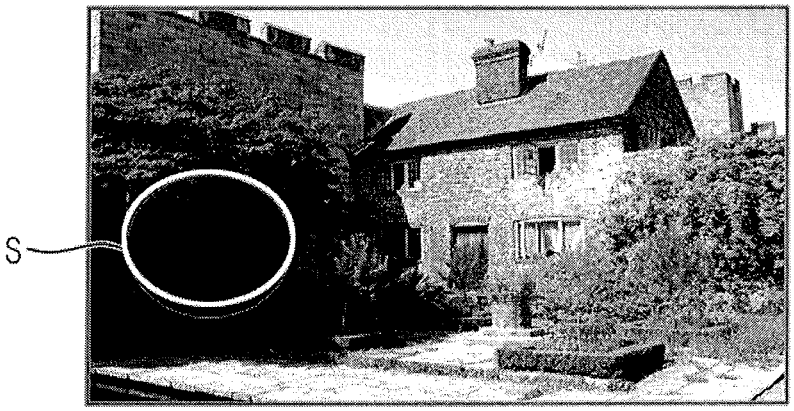

FIG. 5 is an image of the result of an experiment illustrating a detailed enhancement effect when both the local contrast and the global contrast are enhanced as shown in FIG. 2, compared with a detailed enhancement effect when only the global contrast is enhanced in the related art.

FIG. 5(C) is an image obtained when only the global contrast enhancement is performed in the same manner as the related art. As shown in FIG. 5(C), a contrast ratio of the image according to the related art is greater than a contrast ratio of an original image illustrated in FIG. 5(A). However, a detailed loss of a specific portion S of the related art image deepens because of the uniform contrast enhancement in the related art.

On the other hand, FIG. 5(B) is an image obtained when both the local contrast enhancement and the global contrast enhancement are performed in the same manner as the exemplary embodiment of the invention. As shown in FIG. 5(B), a contrast ratio of the image according to the exemplary embodiment of the invention is much greater than the contrast ratio of the original image illustrated in FIG. 5(A), and a detailed loss scarcely exists in a specific portion S of the image. As described above, because the exemplary embodiment of the invention performs the local contrast enhancement prior to the global contrast enhancement, the exemplary embodiment of the invention previously expands a gray level distribution of a portion (for example, a very dark portion or a very bright portion) expected to generate the detailed loss of the image when the global contrast enhancement is performed, thereby minimizing the detailed loss of the image.

Figure 6:
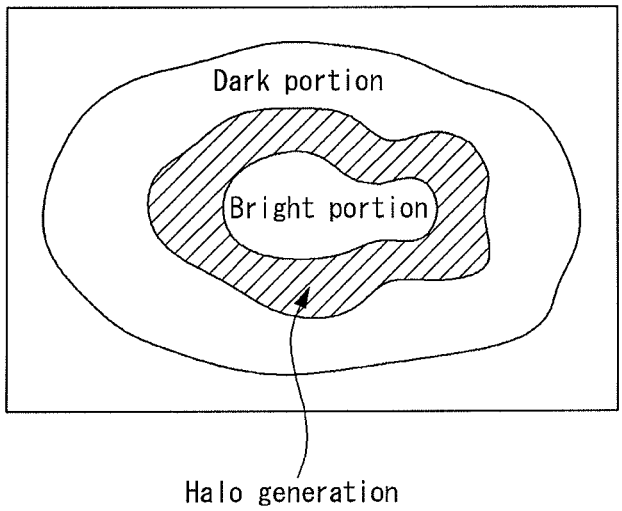
FIG. 6 illustrates an exemplary image in which a halo is generated.

However, when the local contrast enhancement is excessively performed by the local modulation circuit 111 shown in FIG. 2, a halo is generated in a partial image, for example, in a boundary region between partial images (for example, a dark portion and a bright portion) having a high contrast ratio as shown in FIG. 6. The halo phenomenon is generated because all of boundary regions of a real image cannot be represented by a limited number of blocks. A method for solving such a defect is proposed below.

Figure 7:
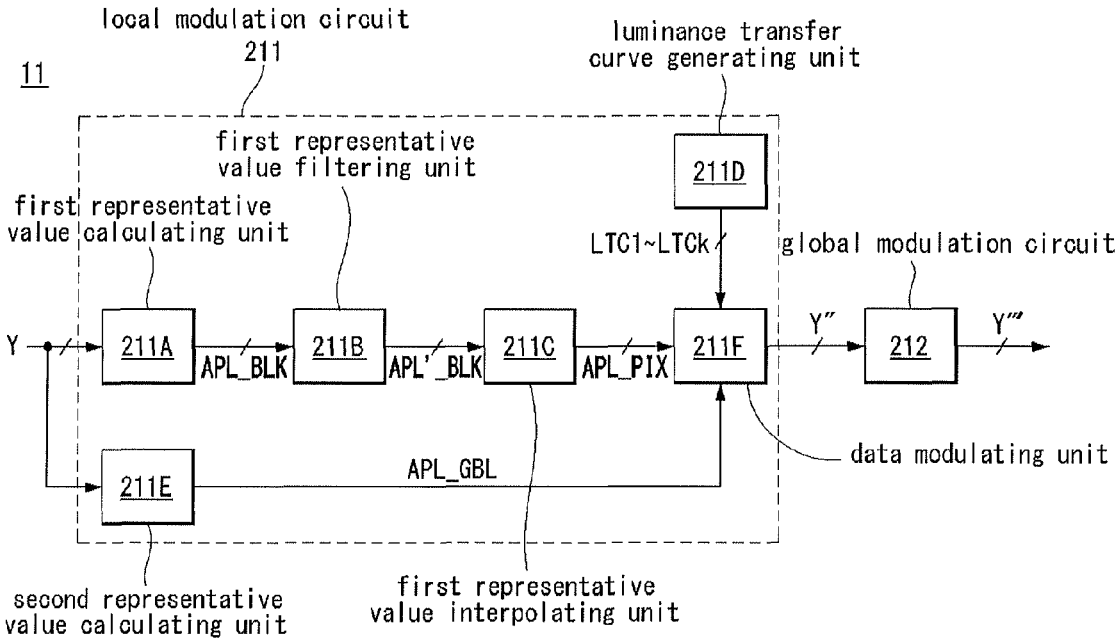
FIG. 7 illustrates another exemplary configuration of a data modulation circuit.

FIG. 7 illustrates another exemplary configuration of the data modulation circuit 11.

As shown in FIG. 7, the data modulation circuit 11 includes a local modulation circuit 211 for local contrast enhancement and a global modulation circuit 212 for global contrast enhancement.

The local modulation circuit 211 includes a first representative value calculating unit 211A, a first representative value filtering unit 211B, a first representative value interpolating unit 211C, a luminance transfer curve generating unit 211D, a second representative value calculating unit 211E, and a data modulating unit 211F.

The first representative value calculating unit 211A receives the luminance components Y of the input digital video data RGB from the luminance/color difference component separating unit (not shown) included in the data modulation circuit 11. The first representative value calculating unit 211A matches the luminance components Y of the input digital video data RGB to the plurality of virtual blocks B (0, 0) to B (n−1, m−1) obtained by dividing the display screen of the display panel 10 in the matrix form as shown in FIG. 3 to calculate a first representative value of each of the virtual blocks B (0, 0) to B (n−1, m−1). The first representative value of each block may be implemented by an APL of each block. The first representative value calculating unit 211A obtains a maximum gray level of each pixel in each block and divides a sum of the maximum gray levels of the pixels included in each block by the total number of pixels of each block, so as to calculate an APL APL_BLK of each block.

Figure 8:
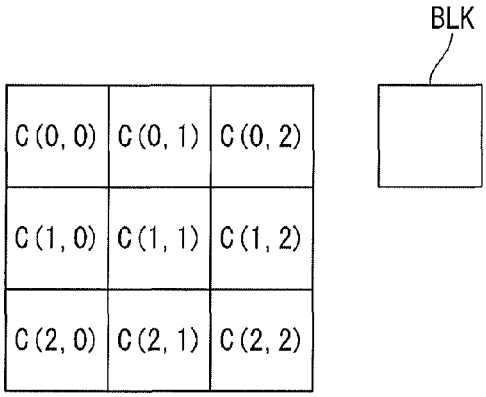
FIG. 8 illustrates a low pass filter.

The first representative value filtering unit 211B receives the APL APL_BLK of each block from the first representative value calculating unit 211A and filters the APL APL_BLK of each block using a low pass filter with j×j size shown in FIG. 8, where j is 3, for example. Hence, a halo generation in a boundary region between the adjacent blocks is prevented. In FIG. 8, C (y, x) indicates a coefficient of the low pass filter, and a weight value of C (1, 1) is set to be greater than weight values of other coefficients having the same value. The first representative value filtering unit 211B may filter the APL APL_BLK of each block through the following Equation 1.

$$APL'_{(i,j)} = \sum_{y=0}^{2}\sum_{x=0}^{2} C_{(y,x)} \times APL_{(i+y-1,j+x-1)} \Big/ \sum_{y=0}^{2}\sum_{x=0}^{2} C_{(y,x)} \quad \text{[Equation 1]}$$

Figure 9:
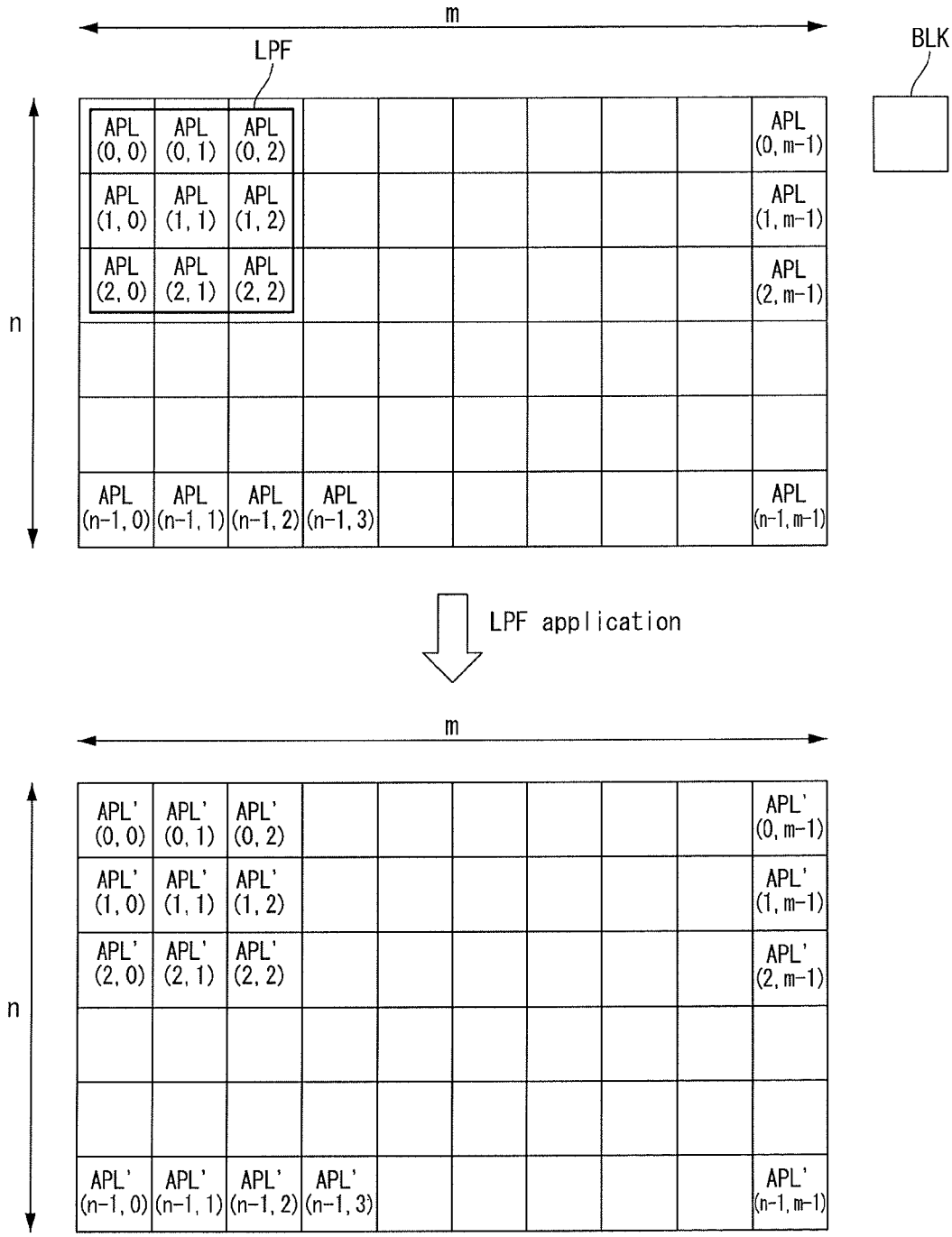
FIG. 9 illustrates an APL of each block before and after a low pass filter is applied.

As shown in FIG. 9, the APL APL_BLK of each block is converted into a filtered APL APL'_BLK of each block by the filtering process using the low pass filter.

The first representative value interpolating unit 211C interpolates the filtered APL APL'_BLK of each block and converts the filtered APL APL'_BLK of each block into an APL APL_PIX of each pixel.

The luminance transfer curve generating unit 211D generates a plurality of luminance transfer curves LTC1 to LTCk previously determined based on the APLs. For example, the luminance transfer curve generating unit 211D may generate five previously determined luminance transfer curves respectively corresponding to 0 APL, 64 APL, 128 APL, 192 APL, and 255 APL. The luminance transfer curves LTC1 to LTCk are set to have different slopes in a plane of input luminance Y-output luminance Y based on the corresponding APLs.

The second representative value calculating unit 211E analyzes the luminance components Y of the input digital video data RGB to calculate a second representative value. The second representative value may be implemented by a global APL APL_GBL representing the entire image.

The data modulating unit 211F receives the APL APL_PIX of each pixel from the first representative value interpolating unit 211C and receives the luminance transfer curves LTC1 to LTCk from the luminance transfer curve generating unit 211D. The data modulating unit 211F selects a luminance transfer curve most suitable for each pixel based on the APL APL_PIX of each pixel. It is preferable that the number of luminance transfer curves is less than the number of APLs for a size reduction of algorithm. Alternatively, the data modulating unit 211F may interpolate adjacent luminance transfer curves at opposite sides of the APL APL_PIX of each pixel to generate a luminance transfer curve corresponding to the APL APL_PIX of each pixel.

The data modulating unit 211F adjusts a slope of the luminance transfer curve selected or generated for each pixel based on the global APL APL_GBL received from the second representative value calculating unit 211E as indicated by the following Equation 2, thereby previously preventing an excessive expansion of a gray level distribution.

$$Y''=(Y'\times\alpha)+(Y\times(1-\alpha)),\ 0<\alpha<1 \qquad \text{[Equation 2]}$$

In Equation 2, Y" is a luminance value by the luminance transfer curve after the slope of the luminance transfer curve of each pixel is adjusted, Y' is a luminance value by the luminance transfer curve before the slope of the luminance transfer curve of each pixel is adjusted, and a is a function value of the global APL APL_GBL.

The data modulating unit 211F maps the luminance components Y of the input digital video data RGB to the luminance transfer curve having the adjusted slope and performs a first modulation on the luminance components Y of the input digital video data RGB. The data modulating unit 211F then outputs first modulated luminance components Y".

The global modulation circuit 212 receives the first modulated luminance components Y" from the local modulation circuit 211. The global modulation circuit 212 performs a second modulation on the first modulated luminance components Y" using various known methods and then outputs second modulated luminance components Y'". The entire contrast i.e., the global contrast of the image is improved through the second modulation. The second modulated luminance components Y'" are combined with color difference components U and V by the luminance/color difference component combining unit (not shown) included in the data modulation circuit 11 to generate the modulated digital video data R'G'B'.

As described above, the display device and the contrast enhancement method thereof according to the exemplary embodiment of the invention divide the image into the plurality of blocks and individually apply the luminance transfer curve of each block, thereby minimizing the detailed loss of the image and improving the contrast characteristic.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A display device comprising:

a display panel on which data lines and gate lines are positioned;

a data driving circuit configured to drive the data lines;

a scan driving circuit configured to drive the gate lines;

a timing controller configured to control the data driving circuit and the scan driving circuit; and a data modulation circuit including a local modulation circuit and a global modulation circuit, the local modulation circuit being configured to map luminance components of input digital video data to a luminance transfer curve for each pixel based on an average picture level (APL) of each pixel and perform a first modulation on the luminance components of the input digital video data so as to expand a gray level distribution of a specific portion of an input image, the global modulation circuit being configured to perform a second modulation on first modulated luminance components of the input digital video data so as to improve an entire contrast characteristic of an input image and supply second modulated luminance components of the input digital video data to the timing controller, wherein the local modulation circuit uses a luminance transfer curve that makes a dark portion of the specific portion to be brighter than before and a luminance transfer curve that makes a bright portion of the specific portion to be darker than before, and wherein the local modulation circuit includes:

a representative value calculating unit configured to match the luminance components of the input digital video data to a plurality of virtual blocks obtained by dividing a display screen of the display panel in a matrix form and calculate an APL of each block as a representative value;

a representative value interpolating unit configured to interpolate the APL of each block and convert the APL of each block into the APL of each pixel;

a luminance transfer curve generating unit configured to generate a plurality of luminance transfer curves previously determined based on the APLs; and a data modulating unit configured to select a luminance transfer curve for each pixel based on the APL of each pixel or interpolate some of the luminance transfer curves to generate the luminance transfer curve corresponding to the APL of each pixel, map the luminance components of the input digital video data to the luminance transfer curve selected or generated for each pixel, and perform the first modulation on the luminance components of the input digital video data.

2. The display device of claim 1, wherein the luminance transfer curves are set to have different slopes in a plane of input luminance-output luminance.

3. The display device of claim 1, wherein the local modulation circuit includes:

a first representative value calculating unit configured to match the luminance components of the input digital video data to a plurality of virtual blocks obtained by dividing a display screen of the display panel in a matrix form and calculate an APL of each block as a first representative value;

a first representative value filtering unit configured to convert the APL of each block into a filtered APL of each block through a low pass filtering;

a first representative value interpolating unit configured to interpolate the filtered APL of each block and convert the filtered APL of each block into an APL of each pixel;

a luminance transfer curve generating unit configured to generate a plurality of luminance transfer curves previously determined based on the APLs;

a second representative value calculating unit configured to analyze the luminance components of the input digital video data and calculate a global APL representing the entire input image as a second representative value; and a data modulating unit configured to select a luminance transfer curve for each pixel based on the APL of each pixel or interpolate some of the luminance transfer curves to generate the luminance transfer curve corresponding to the APL of each pixel, adjust a slope of the luminance transfer curve selected or generated for each pixel based on the global APL, map the luminance components of the input digital video data to the luminance transfer curve having the adjusted slope, and perform the first modulation on the luminance components of the input digital video data.

4. The display device of claim 3, wherein the luminance transfer curves are set to have different slopes in a plane of input luminance-output luminance.

5. The display device of claim 1, wherein the specific portion is a portion with a gray level equal to or less than about 40% of a peak white gray level in the input image or a portion with a gray level equal to or greater than about 60% of the peak white gray level in the input image.

6. A contrast enhancement method of a display device including a display panel on which data lines and gate lines are positioned, a data driving circuit for driving the data lines, a scan driving circuit for driving the gate lines, a timing controller for controlling the data driving circuit and the scan driving circuit, the contrast enhancement method comprising:

mapping luminance components of input digital video data to a luminance transfer curve for each pixel based on an average picture level (APL) of each pixel and performing a first modulation on the luminance components of the input digital video data so as to expand a gray level distribution of a specific portion of an input image; and performing a second modulation on first modulated luminance components of the input digital video data so as to improve an entire contrast characteristic of the input image and supplying second modulated luminance components of the input digital video data to the timing controller, wherein the mapping is using a luminance transfer curve that makes a dark portion of the specific portion to be brighter than before and a luminance transfer curve that makes a bright portion of the specific portion to be darker than before, and wherein the performing of the first modulation includes:

matching the luminance components of the input digital video data to a plurality of virtual blocks obtained by dividing a display screen of the display panel in a matrix form and calculating an APL of each block as a representative value;

interpolating the APL of each block and converting the APL of each block into the APL of each pixel;

generating a plurality of luminance transfer curves previously determined based on the APLs; and selecting a luminance transfer curve for each pixel based on the APL of each pixel or interpolating some of the luminance transfer curves to generate the luminance transfer curve corresponding to the APL of each pixel, mapping the luminance components of the input digital video data to the luminance transfer curve selected or generated for each pixel, and performing the first modulation on the luminance components of the input digital video data.

7. The contrast enhancement method of claim 6, wherein the luminance transfer curves are set to have different slopes in a plane of input luminance-output luminance.

8. The contrast enhancement method of claim 6, wherein the performing of the first modulation includes:

matching the luminance components of the input digital video data to a plurality of virtual blocks obtained by dividing a display screen of the display panel in a matrix form and calculating an APL of each block as a first representative value;

converting the APL of each block into a filtered APL of each block through a low pass filtering;

interpolating the filtered APL of each block and converting the filtered APL of each block into an APL of each pixel;

generating a plurality of luminance transfer curves previously determined based on the APLs;

analyzing the luminance components of the input digital video data and calculating a global APL representing the entire input image as a second representative value; and selecting a luminance transfer curve for each pixel based on the APL of each pixel or interpolating some of the luminance transfer curves to generate the luminance transfer curve corresponding to the APL of each pixel, adjust a slope of the luminance transfer curve selected or generated for each pixel based on the global APL, mapping the luminance components of the input digital video data to the luminance transfer curve having the adjusted slope, and performing the first modulation on the luminance components of the input digital video data.

9. The contrast enhancement method of claim 8, wherein the luminance transfer curves are set to have different slopes in a plane of input luminance-output luminance.

10. The contrast enhancement method of claim 6, wherein the specific portion is a portion with a gray level equal to or less than about 40% of a peak white gray level in the input image or a portion with a gray level equal to or greater than about 60% of the peak white gray level in the input image.

* * * * *